US005195639A

United States Patent [19]

Osbakk

[11] Patent Number: 5,195,639

[45] Date of Patent: Mar. 23, 1993

[54] STACKABLE BOX

[76] Inventor: Georg Osbakk, Boks 42, N-8250, Rognan, Norway

[21] Appl. No.: 893,570

[22] PCT Filed: Jun. 3, 1992

Related U.S. Application Data

[63] Continuation of Ser. No. 768,570 filed as PCT/NO90/00060, Apr. 3, 1990, published as WO90/11942, Oct. 18, 1990, abandoned.

[30] Foreign Application Priority Data

Apr. 11, 1989 [NO] Norway ..... 891493

[51] Int. Cl.[5] ..... B65D 21/02

[52] U.S. Cl. ..... 206/507; 206/519; 206/520

[58] Field of Search ..... 206/515, 516, 518, 519, 206/520, 505, 507

[56] References Cited

U.S. PATENT DOCUMENTS

| | | | |
|---|---|---|---|
| 2,819,557 | 1/1958 | Clark | 206/519 |
| 2,994,457 | 8/1961 | Fornas . | |
| 3,104,044 | 9/1963 | Reifgrs | 206/518 |
| 3,326,408 | 6/1967 | Ringlen | 206/518 |
| 3,498,494 | 3/1970 | Voorhees, Jr. . | |
| 3,609,263 | 9/1971 | Clementi | 206/519 |
| 3,734,341 | 5/1973 | Levenhagen . | |
| 3,982,655 | 9/1976 | Kaupert | 206/519 |
| 3,997,101 | 12/1976 | Florian | 206/519 |
| 4,095,720 | 6/1978 | Delbrouck et al. | 206/519 |
| 4,304,334 | 12/1981 | Hirota . | |
| 4,316,540 | 2/1982 | Lapham . | |
| 4,341,091 | 7/1982 | Minter | 206/519 |

FOREIGN PATENT DOCUMENTS

| | | |
|---|---|---|
| 0312020 | 4/1989 | European Pat. Off. . |
| 1131653 | 2/1957 | France . |
| 1140423 | 7/1957 | France . |
| 89692 | 7/1957 | Norway . |
| 123934 | 5/1972 | Norway . |
| 206612 | 8/1966 | Sweden . |

*Primary Examiner*—Joseph Man-Fu Moy

*Attorney, Agent, or Firm*—Scully, Scott, Murphy & Presser

[57] ABSTRACT

Stackable box for storing and transportation of a number of similar objects, where the front and rear walls of the box being tapered downwards and being provided with upwards tapered webs for transversal support of the objects, the box being provided with an interior shoulder on the interior surface of the walls in the lower portion such that one box may be stacked into another and rest on the shoulder of the lower box, the bottom of the box being such that the bottom of one box may rest on the surrounding flanges provided on the top of a lower box when having correct orientation.

3 Claims, 2 Drawing Sheets

STACKABLE BOX

This is a continuation of copending application Ser. No. 768,570 filed as PCT/NO90/00060, Apr. 3, 1990, published as WO90/11942, Oct. 18, 1990, abandoned.

The present invention is related to a stackable packing box for storing and transport of a plurality of similar objects.

Stackable packing boxes are available in a number of shapes and for different purposes. Boxes for bottles normally are provided with a partition for each bottle and the shape of the boxes provide for the possibility to stack the boxes on each other. This, however, results on the other hand in empty boxes occupying just as much space as boxes containing bottles. If on the other hand the shape of the boxes is such that they may be inserted in each other when they are empty, the weight of one box normally rests on the content of the underlaying box which is unfortunate, especially if the bottles are made of soft plastics and also because the lower box may contain only one bottle, making normal stacking impossible.

The aim of the present invention is to provide a stackable packing box which can be stacked in an other box when empty, thereby occupying a minimum of space for storing and transport and which furthermore can be stacked in an other box and rest on this independently of the lower box containing objects, such as bottles or not.

It furthermore is an object for the present invention to provide a packing box for storing bottles which after use can be pressed in such a way that they only occupy part of their original height, whereby a number of boxes may be stacked into each other with the surpressed bottles, thereafter to be returned for collection and possible recirculation of the bottles.

The above described object is achieved with the packing box according to the present invention as defined by the features stated in the claim.

Figure 2:
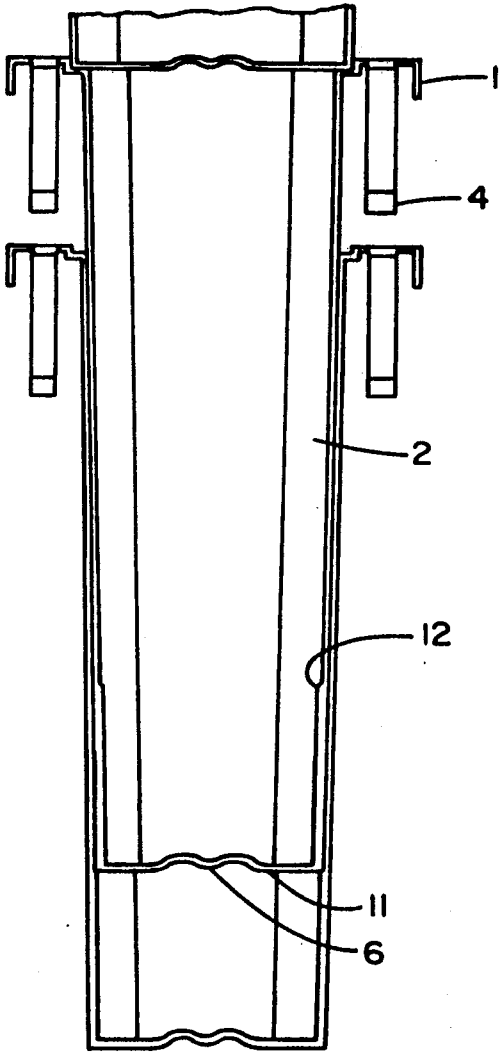
Figure 1:
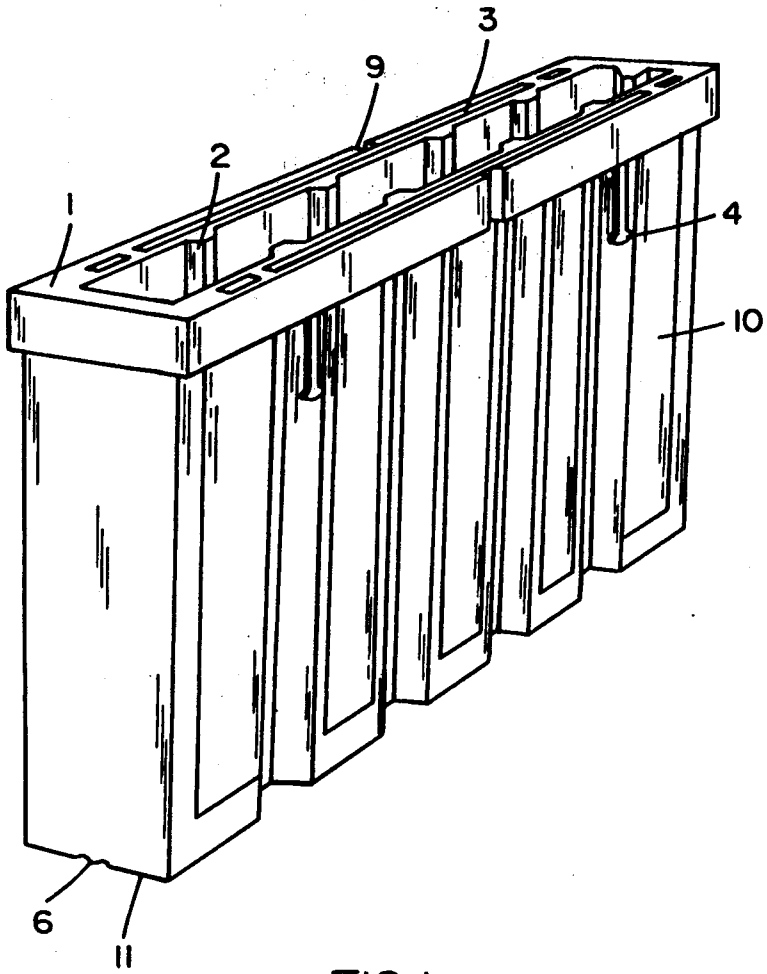
Figure 3:
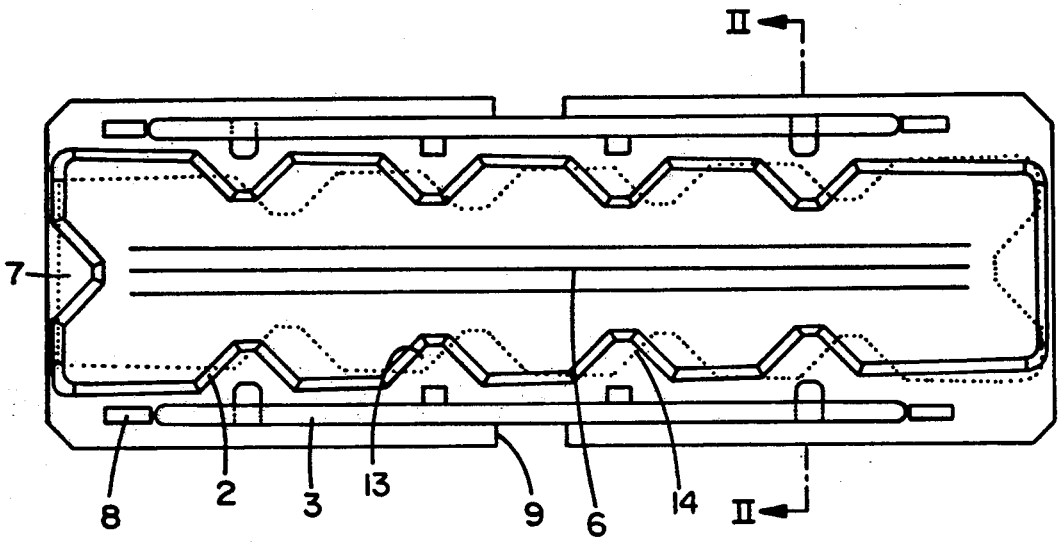
Figure 4:
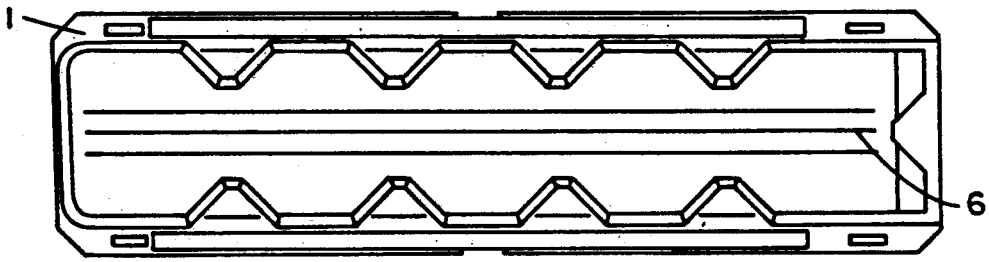

In the drawing, FIG. 1 discloses a packing box according to the invention in perspective, FIG. 2 discloses a section II—II in FIG. 3, FIG. 3 discloses a grant view of a box standing another, indicated lower box and FIG. 4 discloses a ground view of a box having an alternative shape.

The drawing discloses a packing box adapted for storing of five bottles and having for this purpose partition webs 2. Two different embodiments are disclosed in FIG. 3 and 4 respectively. The embodiment according to FIG. 3 has a shape enabling one box to be arranged on top of another box or alternatively by turning the box 180° to be arranged in another box, whereas the embodiment according to FIG. 4 is adapted for arranging a box on top of another box independently of the orientation.

The upper limitation of the box is provided by a surrounding flange 1 having on its upper surface a carrying handle 3 in each of the longitudinal sides of the flange. Preferably the handles are recessed in the flange. The handles 3 may be pulled up to a suitable height limited by an abutment 4 against the lower side of the flange when the handles are pulled up. After pulling up the handles 3, the handles are pressed towards each other and secured to each other by catching bottoms. In this position the two handles together are suitable as a handle for the box and simultaneously also prevent the content in falling out of the box.

As disclosed especially in FIG. 2, the cross section of the box is tapered downwards, which is the case for the front and rear walls as well as the side walls. Based on this fact empty boxes may be stacked into each other as disclosed in FIG. 2. Furthermore FIG. 1 discloses apertures or windows 10 by means of which the content of the box easily can be seen.

By stacking empty boxes into each other the bottom 11 of an upper box will be arranged on a shoulder 12 in the interior of the lower box, thereby establishing a space between the bottoms of the two boxes, which space may contain an empty bottle which has been compressed for recirculation. This also avoids jamming of boxes which are stacked in each other. The distance provided between the two boxes also is such adjusted that the abutments 4 of the handles 3 may remain between the flanges 1 of the two boxes.

Two boxes may be stacked in another if they are such oriented that the web 7 in one of the side walls in both boxes are arranged to the same side. If the two boxes, however, are turned 180° in relation to each other, the bottom of the upper box will be arranged on the upper surface of the flange 1 of the lower box. This is achieved by the side wall comprising the web 7 being somewhat wider than the opposite side wall. An upper box which is turned 180° in relation to a lower edge therefore will be arranged with its bottom to the wider side wall flange of the lower box and its shorter side will rest on the flange of the lower box as disclosed in FIG. 3. The webs 2 and the flanges 1 comprise a portion 13 which is somewhat lower such that an edge 14 is established between the lower portions 13 and the upper surface of the flange 1. Those edges 14 provides for receipt and guidance of the upper box and correspond with the outer shape of the bottom. The edges may be provided in the flange across the broadest side wall or on the web 7.

Two boxes according to another embodiment also may be stacked in another if having the same orientation, with the web 7 in one side wall towards the same side as they are equal and all walls are tapered. If, however two boxes are turned 180° in relation to each other the bottom 11 of the upper box will rest on the webs 2 of the lower box. The upper edge of the webs 2 is provided with a lower portion 13 and an edge 14 is provided between the upper surface and the lower portion 13 for guiding the bottom of the upper box. To achieve this effect the distance from the side wall to the different webs 2 differs from the distance between the other side wall to the different webs.

With this embodiment the boxes may be stacked in each other being equally orientated and resting on the webs 2 of the lower box with its weight and not on the content if the boxes are turned 180° in relation to each other.

The bottom of the box according to the present invention is provided with a center bead 6 extending along the entire length of the bottom. The bead is formed by pressing an inwardly directed channel on each side of the bead. The purpose of this bead 6 is as follows. The bead will abut against bottles which may be stored in a lower box if the two boxes are oriented equally, whereafter the upper box will tilt, thereby indicating for the user that the orientation is wrong already before the user has let go the handle 3 of the upper box. Turning 180° of the upper box will bring the bottom 11 of the upper box in a position for arrangement on the portions 13 of the lower box.

The webs 2 are tapered upwards in such a way that the boxes will fit into each other as the outer surface of the webs in the upper box with a clearance will slide along the inner surface of the webs of the lower box until the bottom of the upper box abuts against the shoulder 12 in the lower box.

Openings 8 are arranged in the flange near the side ends, enabling arrangement of a box on for example a wall. The flange 1 has in each longitudinal side a recess 9 making it easier for the use to catch the handle 3 of the box.

The above described embodiments of the invention are concerned with a rectangular box. The box, however, may have a square shape in such a way that the boxes may be stacked on each other, each turned 90°.

The box according to the invention is especially formed in connection with the use of bottles made of plastics for containing liquids. A bottle of this type may be thrown away after the content has been used, whereby the bottle may be compressed to a height such that the bottle may be arranged between two boxes stacked in each other. Furthermore a box according to the present invention may be used for recirculation of several compressed bottles in boxes stacked on each other. If such a box is filled with a larger mount of compressed bottles for recirculation, these may be locked by the handles which are pulled up and pressed against each other. On the other hand boxes according to the invention are suitable for recirculation of empty, not deformed plastic bottles, especially for payment of bottle deposite, whereby bottles as well as boxes may be collected by bottle receiving machines.

I claim:

1. Stackable box for storing and transportation of a number of similar objects, the front and rear walls of the box being tapered inwardly downwards and being provided with webs for transversial support of the objects, the box being provided with an interior shoulder in a lower portion of the interior surface of the walls such that one box may be placed into another with the bottom resting on the shoulder of the lower box for boxes having the same orientation, the bottom of an upper box resting on a surrounding flange on top of a lower box for boxes having different orientation, CHARACTERIZED IN the box being non-symmetric about a centric transversal axis with a symmetric upper flange on which an upper box rests having opposite orientation from a lower box thereby to allow the lower box to contain objects, the box below the flange being tapered to a trapeze form in a horizontal cross section having one short end wall and one larger end wall and that the surface of the flange having recessed portions to receive the bottom of an upper box, the the recess in the flange above the shorter end thereby having a recess shape to receive the larger end of an upper box.

2. Box according to claims 1, CHARACTERIZED IN the surrounding flanges of in or on another stacked boxes having vertically aligned outer circumference.

3. Box according to claims 1 or 2, CHARACTERIZED IN a groove or bead being provided in the longitudinal direction in the middle of the bottom of the box, preferably on both sides of the bead inwardly directed portions being arranged such that the bead will hit possible objects in a lower box, thereby indicating that the upper box must be turned an angle to be stacked on the lower box, such as 180° for rectangular boxes and 90° or 180° for square boxes.

* * * * *

UNITED STATES PATENT AND TRADEMARK OFFICE

CERTIFICATE OF CORRECTION

PATENT NO. : 5,195,639

DATED : March 23, 1993

INVENTOR(S) : Georg Osbakk

It is certified that error appears in the above-identified patent and that said Letters Patent is hereby corrected as shown below:

On the Title Page, Section [22]: delete "PCT"

Column 1, line 28: "in" should read --on--

Signed and Sealed this

Eighteenth Day of January, 1994

Bruce Lehman

*Attest:*

BRUCE LEHMAN

*Attesting Officer*

*Commissioner of Patents and Trademarks*